US005280660A

United States Patent [19]

Pellerin et al.

[11] Patent Number: 5,280,660

[45] Date of Patent: Jan. 25, 1994

[54] CENTRIFUGAL EXTRACTING MACHINE HAVING BALANCING SYSTEM

[75] Inventors: James W. Pellerin, Metairie; Kenneth W. Gaulter, Destehan, both of La.

[73] Assignee: Pellerin Milnor Corporation, Kenner, La.

[21] Appl. No.: 956,909

[22] Filed: Oct. 5, 1992

[51] Int. Cl.[5] ..... D06F 37/20

[52] U.S. Cl. ..... 8/158; 68/12.06; 68/12.19

[58] Field of Search ..... 8/158, 159; 68/12.06, 68/208, 12.19; 494/7, 82; 210/739, 144

[56] References Cited

U.S. PATENT DOCUMENTS

| | | | |
|---|---|---|---|
| 1,134,547 | 4/1915 | Neahr . | |
| 1,136,233 | 4/1915 | Johnson . | |
| 1,938.327 | 12/1983 | Green . | |
| 2,224,241 | 12/1940 | Verdier et al. | 210/63 |
| 2,311,545 | 2/1943 | Hurley et al. | 68/12 |
| 2,343,742 | 3/1944 | Breckenridge | 68/24 |
| 2,387,216 | 10/1945 | Hood | 210/71 |
| 2,463,801 | 3/1949 | Page | 68/24 |
| 2,534,267 | 12/1950 | Kahn | 74/573 |
| 2,534,268 | 12/1950 | Kahn et al. | 74/573 |
| 2,534,269 | 12/1950 | Kahn et al. | 74/573 |
| 2,612,766 | 10/1952 | Smith et al. | 68/12 |
| 2,635,446 | 4/1953 | Smith | 68/12 |
| 2,635,546 | 4/1953 | Enyeart et al. | 103/12 |
| 2,637,189 | 5/1953 | Douglas | 68/24 |
| 2,647,386 | 8/1953 | Keiper | 68/23 |
| 2,717,698 | 9/1955 | Armstrong | 210/63 |
| 2,772,577 | 12/1956 | Sharp | 74/359 |
| 2,780,086 | 2/1957 | Dunlap | 68/24 |
| 2,849,894 | 9/1958 | Brusdal | 74/573 |
| 2,873,010 | 2/1959 | Alma | 192/88 |
| 2,886,979 | 5/1959 | Baxter | 74/573 |
| 2,890,580 | 6/1959 | Etherington | 68/12 |
| 2,903,854 | 9/1959 | Harty | 60/54.5 |
| 2,911,812 | 11/1959 | Metzger | 68/12 |
| 2,941,390 | 6/1960 | Frey | 68/24 |
| 3,060,713 | 10/1962 | Burkall | 68/208 |
| 3,117,926 | 1/1964 | Starr et al. | 210/144 |
| 4,224,811 | 9/1980 | Yamashita | 68/208 |

FOREIGN PATENT DOCUMENTS

| | | | |
|---|---|---|---|
| 3145588 | 5/1983 | Fed. Rep. of Germany | 68/12.06 |
| 682769 | 4/1949 | United Kingdom . | |
| 697085 | 7/1950 | United Kingdom . | |
| 1120431 | 8/1965 | United Kingdom . | |
| 1401055 | 6/1972 | United Kingdom . | |
| 1403369 | 9/1972 | United Kingdom . | |

OTHER PUBLICATIONS

Encyclopedia Britannica, vol. 1, 15th Ed. (1987), definition of accelerometer.

*Primary Examiner*—Frankie L. Stinson
*Attorney, Agent, or Firm*—Vaden, Eickenroht, Thompson, Boulware & Feather

[57] ABSTRACT

There are disclosed an apparatus for and method of electronically balancing a machine for extracting fluids out of a load of liquid absorbent goods received in a rotatable drum by detecting the magnitude and location of the imbalanced load and injecting a balancing fluid into hollow balancing compartments, located within the drum, until the magnitude of the imbalanced load reaches a permissible level.

14 Claims, 8 Drawing Sheets

CENTRIFUGAL EXTRACTING MACHINE HAVING BALANCING SYSTEM

BACKGROUND OF THE INVENTION

1. Field of the Invention

This invention relates generally to a machine including a rotatable drum for extracting liquid out of liquid absorbent goods received in the drum during rotation of the drum at high speeds. Specifically, this invention relates to improvements in such machines having systems for at least partially balancing the drum to correct imbalances due to unequal distribution of goods about its inner circumference.

2. Description of the Prior Art

In a machine of this type, typically a washer/extractor, the drum is contained in a housing which is supported by a frame. The drum rotates about its axis at relatively slow speeds during the initial cycles of washing and at high speeds during a final cycle in order to extract the liquid from the goods. The lower speeds range from less than 20 to 65 revolutions per minute (rpms) while the high speeds can reach in excess of 1,000 rpms.

Most machines are designed to withstand the unavoidable vibration due to the high speed revolution of the drum. During such high speeds, liquid absorbent goods are plastered against the side of the rotating drum. Very rarely are the goods evenly distributed about the drum. Thus, an unequal distribution of weight will create an imbalance which can over time cause severe damage to the washer/extractor including the structure supporting the housing and the mechanism rotating the drum.

Several attempts have been made to compensate for the imbalance to prevent damage to the machine in rigid mount models. The difficulties associated with finding a solution for the imbalance problem include identifying the magnitude of an imbalance, identifying the location of the imbalance in the rotating drum, and offsetting the imbalance during the extraction process.

One such attempt is described in U.S. Pat. Nos. 2,534,267/268/269, Kahn, et al wherein the drum includes three inwardly directed hollow ribs, which are spaced about the drum to function not only as lifters for tumbling the goods, but also as balancing compartments for receiving a balancing fluid. Balancing fluid is independently injected into each compartment by balancing fluid injection valves that are selectively activated to inject balancing fluids into the respective compartments to compensate for any imbalance.

These Kahn systems utilize a magnetic vibration pick up device to determine the magnitude of an imbalance during an extraction cycle. This device is a fixed reference device in that part of it is mounted on the vibrating housing or frame supporting the drum, while the other part is mounted at a point which is fixed relative to the vibrating frame. A distributor disk or commutator whose rotation is synchronized with that of the rotating drum is used to identify the location of the imbalance. A solenoid or actuation mechanism of the balancing fluid injection valve is actuated by the simultaneous receipt of signals from the magnetic vibration pick up device and the distributor disk.

One problem with the Kahn system is expansion and contraction of cooperating parts of the vibration pick up device due to wear, settling, and temperature changes, necessitating constant adjustments. Another problem with this system is that the energizing means actuates the balancing fluid injection valve with each revolution of the drum. Balancing fluid passes through the valve during the entire revolution of the drum even though the valve is only actuated for a short time during the revolution because the mechanical response time closing the valve is slower than the electrical response time. The service life of the valve is significantly reduced by wear on the valve due to the repeated actuation of the valve during each rotation of the drum.

Yet another problem associated with the Kahn system is that it is inflexible with respect to choosing which balance compartments are actuated and when they are actuated. Once the system is designed and constructed, only specific injectors are activated relative to certain imbalances. If a user finds that different injectors should be actuated or that more than one should be actuated at a time, he cannot do this without significantly changing the system.

Still another problem is that the balancing system provides no way to terminate the extraction process if the imbalance exceeds permissible limits. Sometimes an imbalance reaches a level incapable of being balanced by the balancing system, at which point the speed of the machine should be reduced so the liquid absorbent goods can be redistributed around the drum to avoid damage to the machine.

Finally, the sensitivity and accuracy of the Kahn system is limited to the resolution of the commutator which has a cam operated switch for each of the balancing valves. For example, when an imbalance is not directly opposite a rib, two ribs will simultaneously be injected. Whereas, if the imbalance is directly located opposite a rib, only that rib will be injected. The accuracy of this process is dependent on the sensitivity of these mechanical switches.

U.S. Pat. No. 3,117,962, Starr discloses a machine having a system designed to overcome some of the problems of the Kahn systems. It has a mechanical vibration sensing device incorporating a fluid filled container, mounted in a fixed position relative to the vibrating frame, and closed on one side by one moveable member positioned to be displaced by vibrations of the drum and on the other side by a second moveable member displacement which actuates a mechanical switch. This mechanical vibration sensing device also incorporates an orifice (placed below a reservoir) which prevents slow movements of the vibration detection side from actuating the mechanical switch, while high speed motions would be transmitted, due to the viscosity of fluid in the container. As a result the unit is self compensating for wear, settling, and environmental changes and therefore does not require constant adjustment. Although a commercially successful modification of the machine disclosed in the Kahn patent, the latter machine nevertheless suffers from at least certain of the problems mentioned above. In addition, its sensing device requires several additional mechanical parts which can fail over time.

Additionally, the housings of the machines described in Kahn and Starr are rigidly mounted so whatever residual imbalance remains in the machine after the balance sequence is transmitted to the structure supporting the frame. Thus, installation of these machines is limited to structurally sound environments. Later, the machine of the Starr patent was further modified to flexibly support its housing, wherein the housing becomes a spring supported mass, in order to isolate the vibration so the machines were capable of being installed in less structurally sound environments.

In a rigid mount machine, the amount of excursion of the frame relative to a fixed position in space is linear with respect to the vibration force created. On the other hand, a flexibly supported machine undergoes a transition where the spring supported mass system experiences a resonant condition as the rotating drum accelerates from the lower speed ranges to the higher speed ranges. This resonant condition produces excursions which are extreme compared to the movements of a rigid mount machine. Even after the machine accelerates through its resonant frequency (at approximately 100 rpm) the amount of excursion of the spring supported mass relative to a fixed point in space is far greater than that of a rigidly mounted machine.

Since the fixed reference, vibration sensing mechanisms in both the Kahn and Starr machines were designed to measure very small displacements that occur in the rigid mount system, excursions generated in a flexibly supported machine would destroy them. Thus, the fixed reference device of the modified Starr machine has required complex changes.

It is the primary object of this invention to provide a machine of the type described, and particularly one in which the housing is flexibly mounted, in which these and other problems are overcome.

Another object is to provide such a machine having a balancing system which is of such construction that large initial excursions may be detected in a simple and inexpensive manner and without risk of damage.

A further object is to provide such a machine having a balancing system in which the proper balancing compartments are determined and then filled in such a manner as to reduce wear on the parts of the system as well as to reduce the number and likelihood of malfunctions of the parts.

It is another object of the present invention to provide such a machine having an improved balancing system which prevents damage to the machine when the load cannot be balanced because the imbalance exceeds a maximum allowable level.

It is yet another object of the present invention to provide such a machine having an improved balancing system where the choice of which and when balancing ribs are injected with fluid is not limited to the mechanical constraints of the machine.

It is still another object of the present invention to provide such a machine having an improved, more accurate and sensitive balancing system.

SUMMARY OF THE INVENTION

These and other objects are accomplished, in accordance with one novel aspect of the invention, by a machine of the type described, together with a method of balancing the same, wherein the housing is flexibly supported and the magnitude of an imbalance is determined by an accelerometer or similar device mounted on the housing. This determination, together with a means for detecting the location of the imbalance, enables at least one injection means to be activated for injecting balancing fluid into a selected compartment in order to substantially offset the imbalance.

Since the device does not rely on a fixed reference, it is able to determine the magnitude of an imbalance without being destroyed, regardless of excessive initial excursions. Preferably, the accelerometer is mounted on the end of the outer housing, which experiences greater movement due to the vibration than any other part of the housing, in order to detect the imbalance at the earliest possible moment.

In accordance with another novel aspect of the invention, the means for detecting the location of the imbalance comprises a means for determining passage of a target which is rotatable with the inner drum with respect to a reference point which is stationary relative to the inner drum, and a means for determining the lapse of time to reach the location of imbalance following passage of the target beyond the stationary reference point. More particularly, a means is provided which is operable, when the magnitude of the imbalance reaches a threshold level, and, based upon the lapse of time, to select and activate at least one injection means in order to substantially offset the imbalance, together with a means for deactivating the injector means when the magnitude of the imbalance falls below the threshold level. Such a system not only reduces the number of mechanical parts, as compared with the prior systems, but also activates the injector means only once during the balance process thereby reducing wear on the injector valve solenoid and enhancing the sensitivity and accuracy of the overall balancing system.

Preferably, the means for determining passage of the target is a proximity switch mounted at the stationary reference point relative to the target, such that the target reaches a location to activate the proximity switch once per revolution of the inner drum. Also, the means to select and activate at least one injector means preferably includes a memory element having predetermined values that correlate at least one of the injector means with the lapse of time stored therein, and means for accessing the memory element to identify the injector means corresponding to the lapse of time and generating and maintaining an injector means actuation signal for the injector means as long as the magnitude of the imbalance exceeds the threshold value. Thus, the selection of a particular injector means for an imbalance can be easily changed by changing the information in the memory element.

BRIEF DESCRIPTION OF THE DRAWINGS

In the drawings, wherein like reference characters are used throughout to designate like parts.

DESCRIPTION OF THE PREFERRED EMBODIMENT

Figure 1:
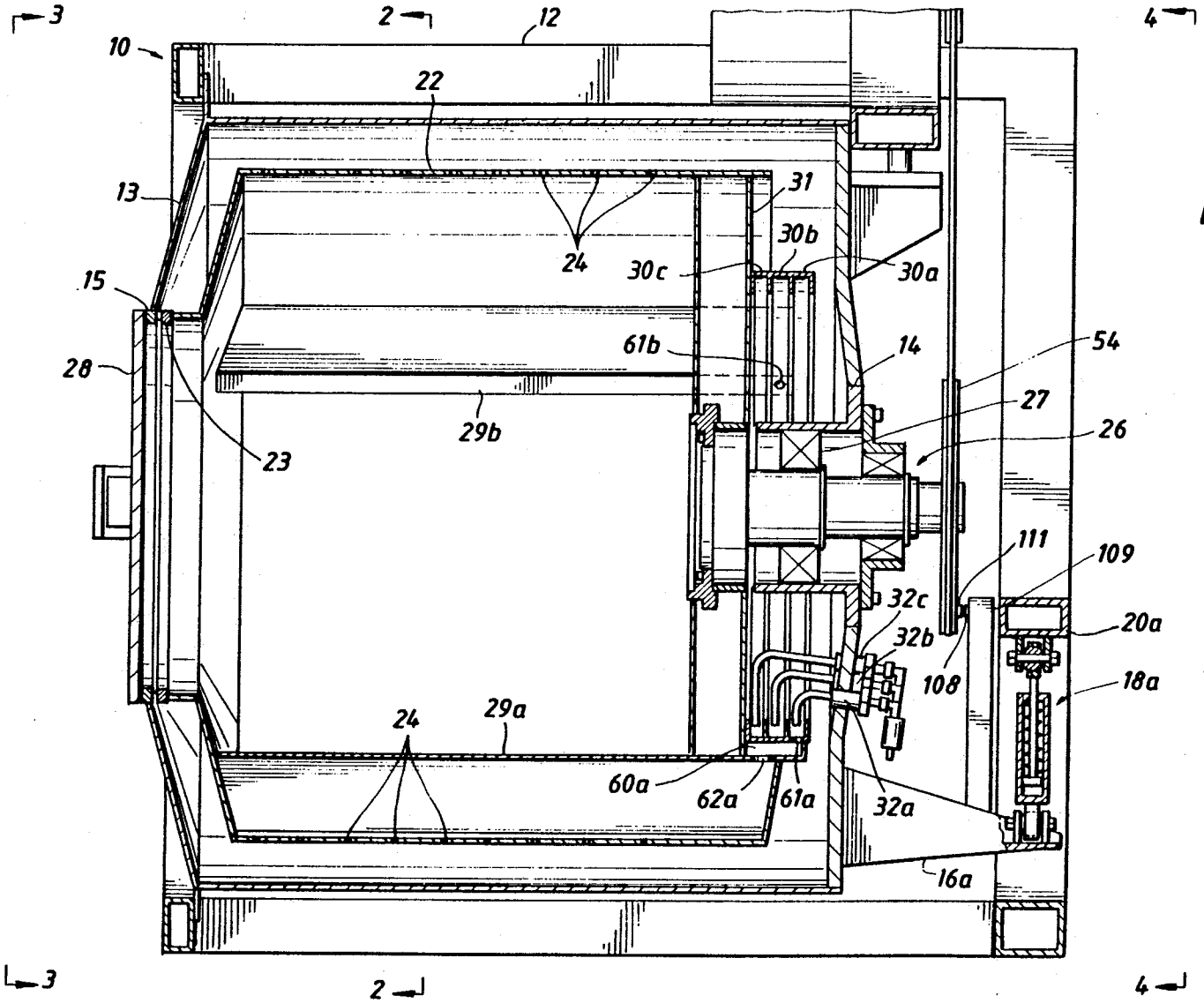
FIG. 1 is a longitudinal-sectional view of a machine constructed in accordance with the present invention.
Figure 2:
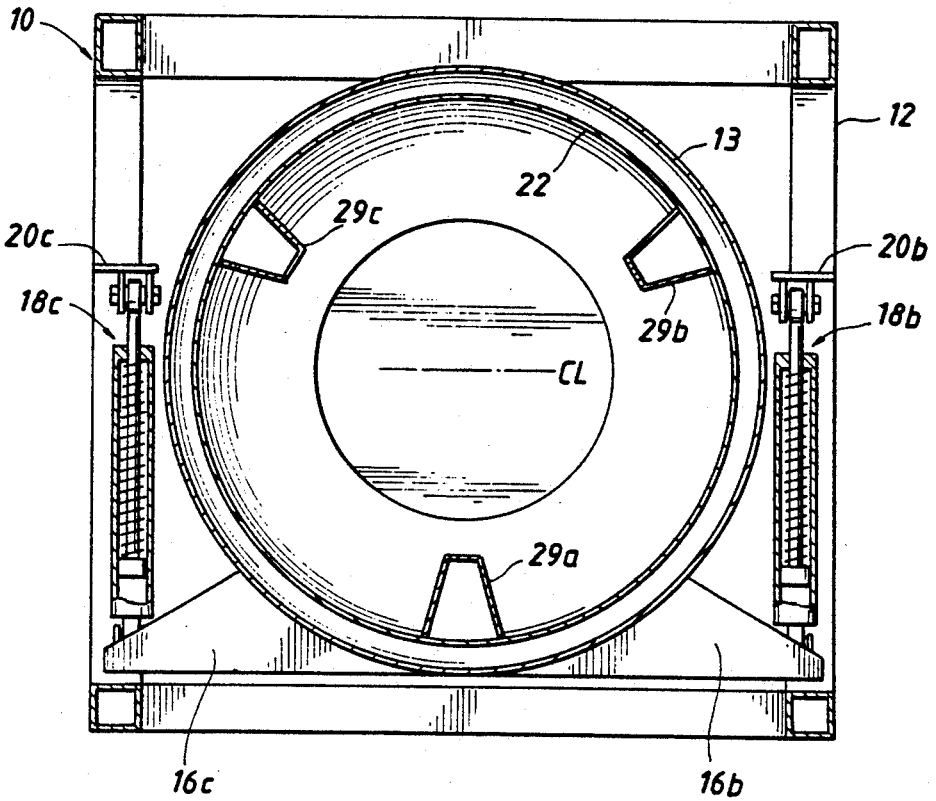
FIG. 2 is a cross-sectional view of the machine as seen along broken lines 2—2 of in FIG. 1.

With reference now to the details of the above-described drawings, machine 10, shown in FIGS. 1–4, comprises a stationary frame 12 and outer housing 13 yieldably mounted on the frame. Thus, support arms, 16*a*, 16*b*, and 16*c* on the housing are mounted on resilient support means 18*a*, 18*b*, and 18*c* which are in turn suspended from plates 20*a*, 20*b*, and 20*c* on frame 12. The exact location and size of plates 20*a*, 20*b*, and 20*c* relative to respective support arms 16*a*, 16*b*, and 16*c* depends on the center of mass of outer housing 13, including all attachments thereto, inner drum 22, the expected average mass of goods and absorbed water that will be received in inner drum 22, and the resiliency of the respective support means. Although outer housing 13 and inner drum 22 are cylindrically shaped in this embodiment of the invention, these structures could be of any other suitable shape.

An inner drum 22 is mounted within the housing for rotation about its axis by means of a shaft 26 at one end extending through a bearing 27 carried within opening 14 in the end of the housing. The drum has an inlet opening 23 in the other end and perforations 24 about its circumference. Inlet 23 sealingly and rotatably registers with opening 15 in the opposite end of outer housing 13 and is closed by a door 28 over opening 15.

Figure 3:
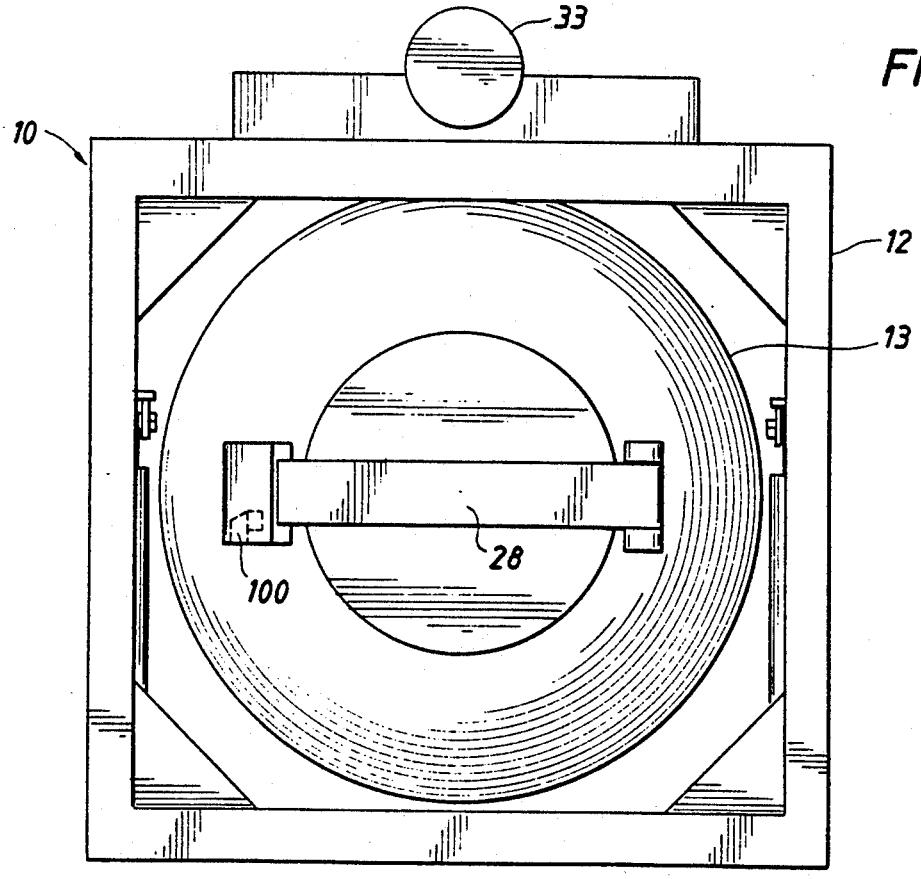
FIG. 3 is a view of one end of the machine as seen from broken likes 3—3 of FIG. 1.
Figure 4:
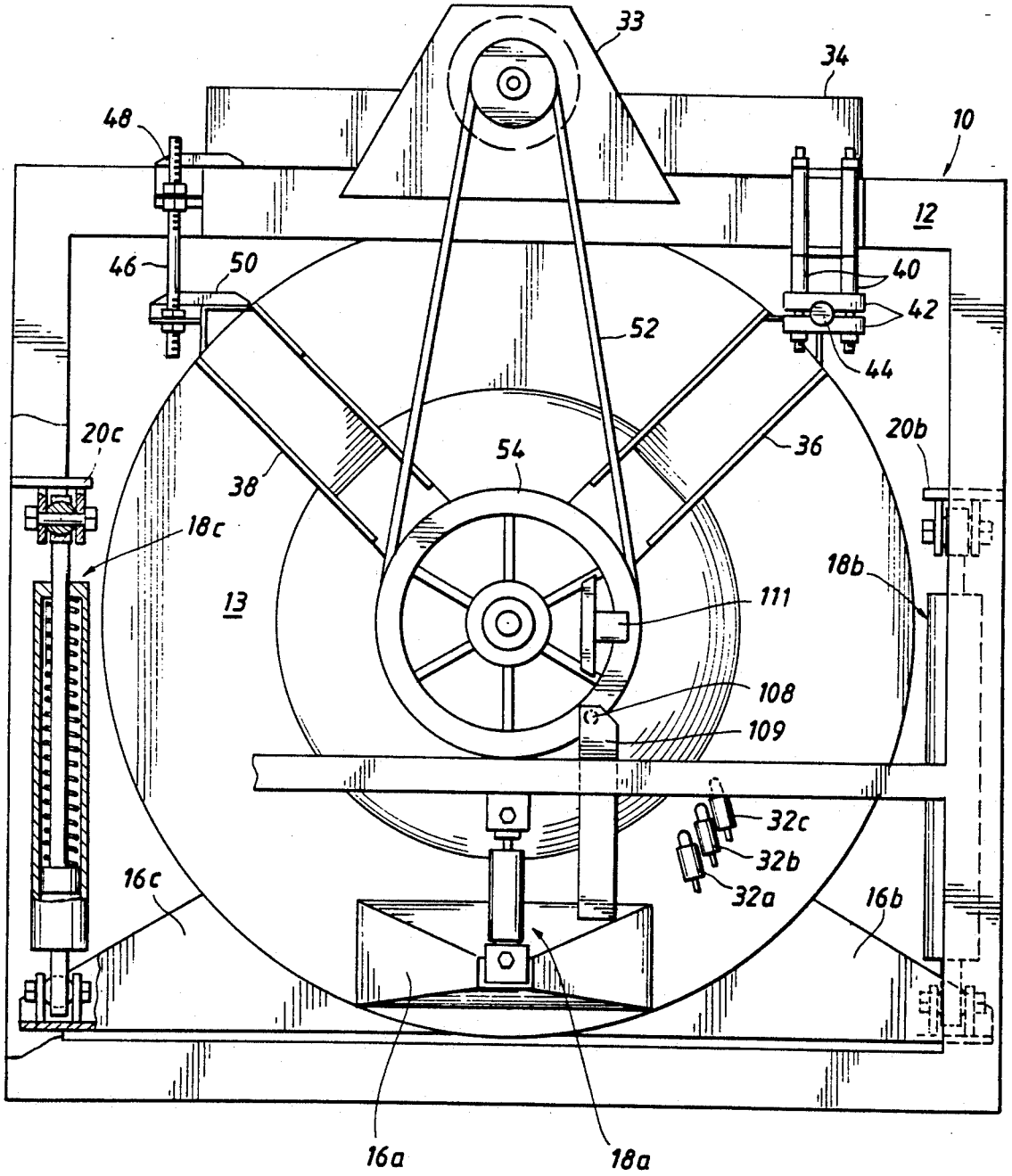
FIG. 4 is a view of the other end of the machine, as seen from broken lines 4—4 of FIG. 1.

As shown in FIGS. 3 and 4, a motor 33 is mounted on a platform 34 which in turn is removably mounted on the top of outer housing 13 through load bearing members 36 and 38. Bolts 40 pass through motor platform 34 and plates 42 which surround load bearing shaft 44 that is permanently mounted to load bearing member 36. Motor platform 34 is clamped to load bearing member 38 by stabilizing screw 46 and shoulders 48 and 50 which are fixedly mounted to motor platform 34 and load bearing member 38, respectively. The tension in drive belt 52 that drives pulley 54 is varied by adjusting the distance between shoulders 48 and 50 through stabilizing screw 46. Pulley 54 turns drive shaft means 26 and thus turns inner drum 22 at the same speed as pulley 54.

Ribs 29*a*, 29*b*, and 29*c*, in the housing, equally spaced about the inner drum 22 function as lifters to tumble the goods during a low speed cycle, such as a washing cycle, and are hollow to form compartments for receiving balancing fluid that is injected in at least one predetermined hollow rib when the magnitude of an imbalance in the load of goods reaches a predetermined threshold level. An assembly of feed rings 30*a*, 30*b*, and 30*c* are fixed to back wall 31 of inner drum 22 for rotation therewith and are open along their inner sides so as to receive balancing fluid injected thereinto by respective injection valves 32*a*, 32*b*, and 32*c*. The fluid will be retained in the ribs when inner drum 22 is rotated at a speed sufficient to throw the balance fluid centrifugally against the outer periphery of the rings.

One end of each hollow rib projects past back rear wall 31 of the drum to overlap respective feed ring channels for receiving balancing fluid from feed rings through connecting channels and ports. For example, hollow rib 29*a* receives balancing fluid from injection valve 32*a* which conveys the balancing fluid into feed ring 30*a*, through port 61*a*, into channel 60*a*, and into hollow rib 29*a* through port 62*a*.

To the extent described above, the machine is of more or less conventional construction adapted for use as a flexibly supported washer/extractor. Thus, goods are introduced into inner drum 22 through opening 15 and inlet opening 23, and after door 28 is closed, the washing cycle begins by introducing liquid through a liquid injection means (not shown) into outer housing 13 and rotating inner drum 22 through pulley 54. During the washing and rinsing cycles, the rotational speed of inner drum 22 normally ranges from less than 20 to 65 revolutions per minute (rpms). During the wash and rinse cycles and prior to the extraction cycle, water is drained from outer housing 13 and inner drum 22 through a drain (not shown) and, from the hollow ribs as shown and described in U.S. Pat. No. 3,117,926, which is hereby incorporated by reference. After the drain cycle, inner drum 22 is rotated at speeds which could exceed 1000 rpms to extract the remaining fluid from the goods, during which, as will be described and to follow, balancing fluid, which in the preferred embodiment of this invention is water, is injected into at least one hollow rib to counterbalance an imbalance.

Figure 6:
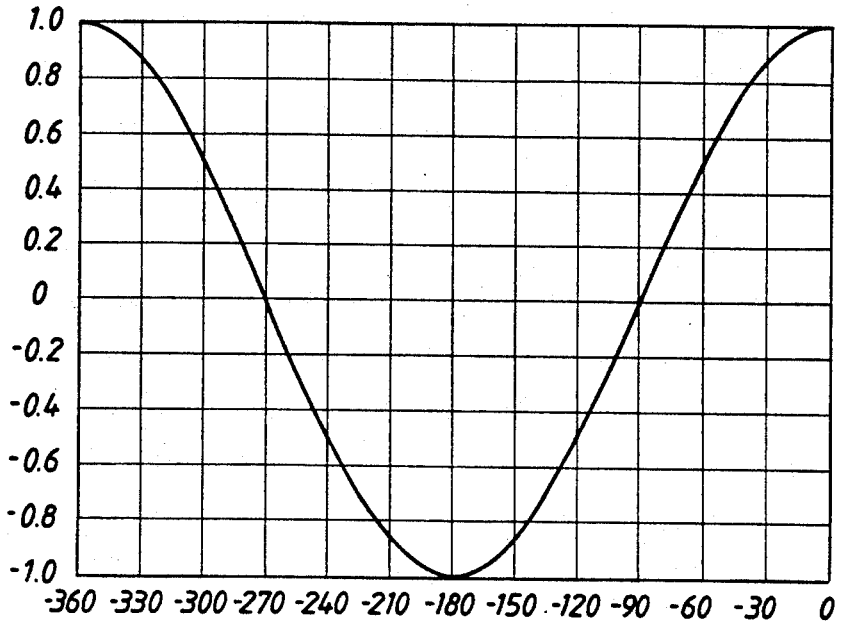
FIG. 6 is a graphical representation of the output signal from the vibration detection means shown in FIG. 5, during one revolution of the rotating drum of the machine wherein the peak of the signal represents the magnitude of the imbalance.

In the preferred embodiment of this invention, the means utilized for detecting and determining the magnitude and location of the imbalanced load is a vibration detection device which is independent of a fixed reference. For this purpose, a solid state accelerometer 100, such as a model number NAS-002G, manufactured by NovaSensor, located in Fremont, California, is mounted on outer housing 13 to sense acceleration along a particular axis, and thus generate an electrical output that is a sine wave such as that shown in FIG. 6. The period of the sine wave is the time for the completion of one revolution of rotating inner drum 22. The magnitude of the peak of the sine wave is proportional to the magnitude of an imbalanced load of goods in rotating inner drum 22. Since accelerometer 100 is reference point independent, it will not be damaged by the excursion experience by the flexibly supported outer housing 13 as would the previously described vibration detection means in the prior art.

In this embodiment, the accelerometer 100 is mounted on door 28 on the front of outer housing 13 (see FIG. 3) because, in this system configuration, the front end of outer housing 13 undergoes more movement relative to the back where more weight exists due to the motor 33 and all the other devices instrumental in rotating inner drum 22. Accelerometer 100 is oriented to detect acceleration of outer housing 13 along the horizontal axis across the front of the housing. However, it could be placed anywhere on outer housing 13 to measure acceleration along any axis.

As best shown in FIG. 4, a metal target 111 is mounted on periphery of pulley 54, and thus for rotation with the inner drum 22 driven by the pulley 54. More particularly, the target is mounted so as to be angularly aligned with one of the ribs, in this embodiment, rib 1, as will be referred to hereinafter. Even though the target is angularly aligned with rib 1, the target could be angularly aligned with any point on inner drum 22. Also, a proximity switch 108 is mounted on proximity switch assembly 109 which is mounted on support arm 16*a*, so that a pulse 106 (see FIG. 5) will be generated by proximity switch 108 each time metal target 111 passes it during each revolution of the drum. The position of the proximity switch will hereinafter be called the stationary reference point.

The proximity switch used in the preferred embodiment of this invention is model number 922AA4N-A9N-L, manufactured by Micro Switch, Inc., located in Freeport, Ill. Any device which could identify passage of a point on inner drum 22 could be used in place of the proximity switch.

Figure 5:
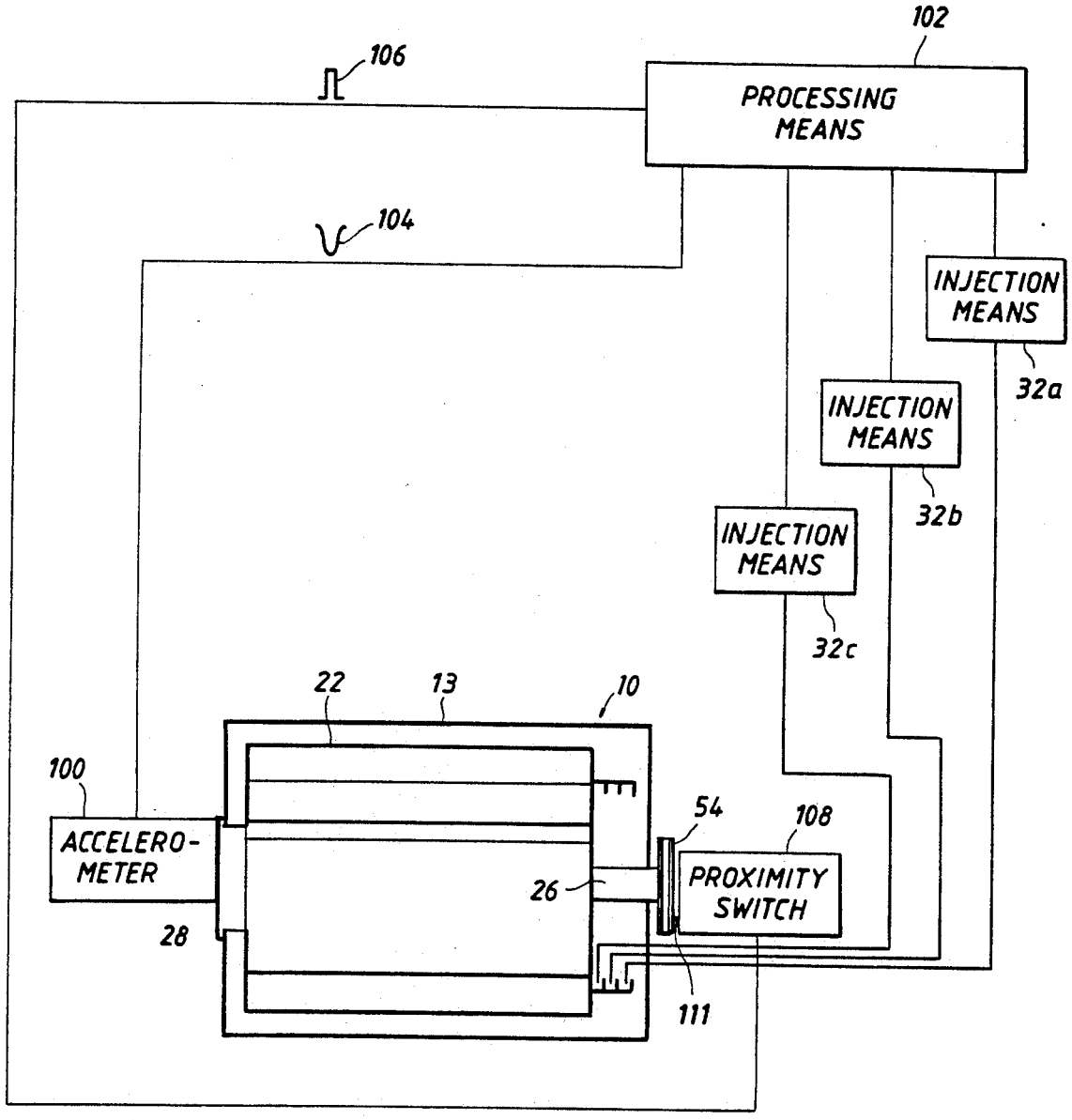
FIG. 5 is a block diagram of the system used to balance the machine.

As shown diagrammatically in FIG. 5, the means for determining the location and magnitude of an imbalanced load in inner drum 22 includes processing means 102 that monitors output signal 104 from accelerometer 100 and output signal 106 from proximity switch 108. Processing means 102 includes a timer that is used to determine the period, "T", of the waveform shown in FIG. 6 by calculating the time between leading edges of consecutive output signals 106 which represents the time for one full revolution of inner drum 22. The timer is also utilized to find the time from when the last output signal 106 of proximity switch 108 is detected to when the peak amplitude of an imbalance is detected, which will hereinafter be called "time t". The period of output signal 104, T, and time t are used by processing means 102 to determine which rib or ribs should be injected with water to balance the load.

Figure 7:
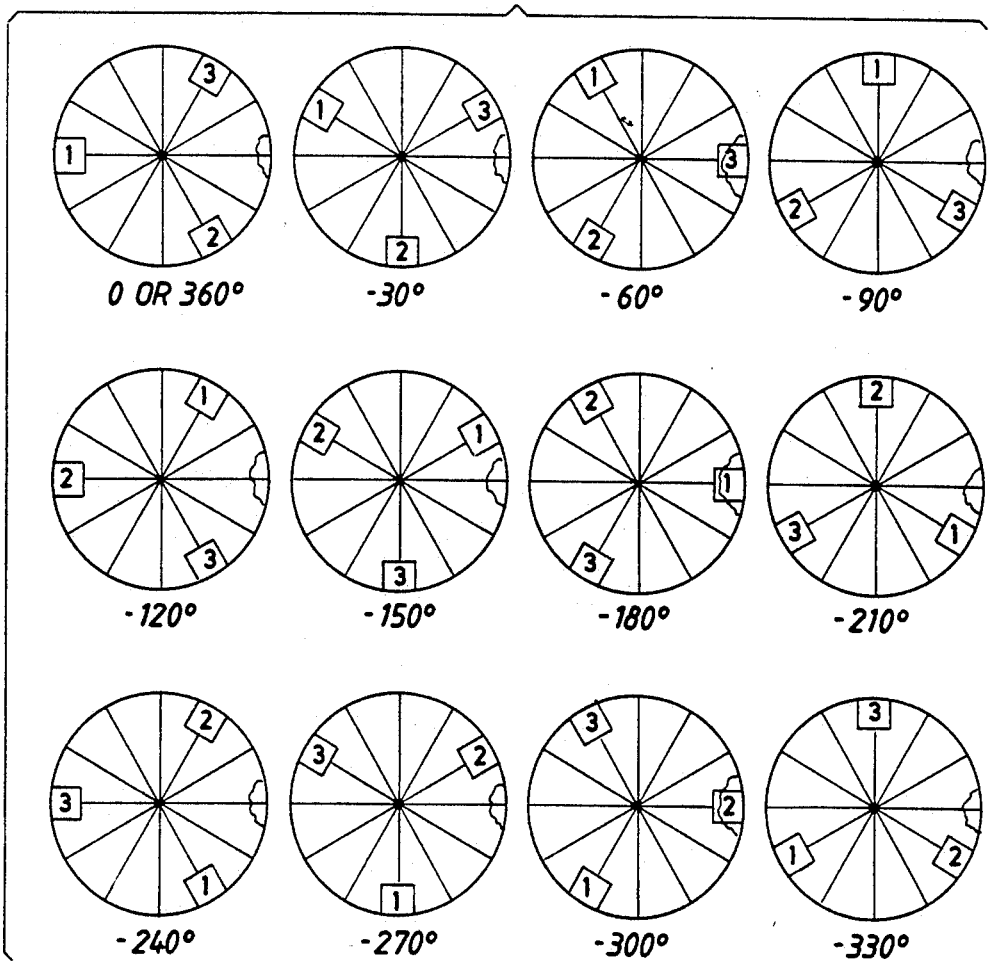
FIG. 7 is a diagrammatical representation of the relationship, stored in a system memory element, between the location of an imbalance represented by the peak of the signal shown in FIG. 6, located at 3 o'clock in each circle, and the location of one of the ribs relative to a stationary reference point, located at 9 o'clock in each circle.

FIG. 7 shows the relationship of the imbalance location relative to rib 1 in order to determine which rib should be injected with water to balance the load. Since, in this embodiment, the reference point is located on pulley 54 so as to be angularly aligned with rib 1 on inner drum 22, the period T is the time for rib 1 to make one revolution. The period T is divided into twelve intervals in this embodiment of the invention. The stationary reference point for the detection of the passage of rib 1 is indicated by the mark 0 or 360° where rib 1 is at the 9 o'clock position. The imbalance is always located on the horizontal axis at the 3 o'clock position. Therefore, if the imbalance is detected when rib 1 reaches the stationary reference point, the imbalance is located directly across from rib 1. If the imbalance is detected after rib 1 has traveled −30° from the reference point, the imbalance is located between ribs 2 and 3 but is closer to rib 3.

The circumferential movement of rib 1 from the stationary reference point is correlated to time and is used to identify the location of the imbalance and thus to identify which ribs should be injected. For example, if the imbalance is detected when rib 1 rotates −120° past the reference point, time t is 4 T/12 and the imbalance is located directly across from rib 2, as shown in FIG. 7. If rib 1 rotates −180° past the reference point, time t is 6T/12 and the imbalance is located at rib 1. Since the time and location of the imbalance is known, a rib injection process, that is, selecting the appropriate rib to be injected for a given time t, is determined so that processing means can actuate the appropriate injection means 32*a*, 32*b*, or 32*c* (shown in FIG. 5). Injection means 32*a*, 32*b*, or 32*c* can be an electronically responsive injection valve well known to those skilled in the art.

In the preferred embodiment of this invention, a single stage rib injection process is implemented. If time t indicates the imbalance is located directly across from a rib, that rib is injected with water until the magnitude of the imbalance falls below an acceptable level. If time t indicates the imbalance is not located directly across from a rib, then two predetermined ribs are injected simultaneously, at the same rate, to effectively move the location of the imbalance directly across from a rib, at which time that rib is injected to counterbalance the imbalance. For example, if the imbalance is detected when rib 1 has traveled −270° from the stationary reference point, FIG. 7 shows the imbalance to be between ribs 1 and 2, but closer to rib 2. In order to move the effective location of the imbalance directly across from rib 3, ribs 1 and 3 are injected. When time t indicates the imbalance is effectively across from rib 3, the injection of water into rib 1 ceases and continues into rib 3 until the magnitude of the imbalance falls below an acceptable level.

In order for processing means 102 to select the appropriate injections means, predetermined values indicating which rib is injected for time t are stored in a memory element accessible by processing means 102. The following table shows the relation between time t and the injected ribs utilized in the preferred embodiment of this invention, wherein, as above described, metal target 111 is angularly aligned with rib 1.

| Time t | Angular Location of Rib 1 from Stationary Reference Point | Imbalance Located Across from a Rib or Between Two Ribs | Rib or Ribs to Get Balancing Fluid |
|---|---|---|---|
| 0 | 0, 360° | 1 | 1 |
| 0 < t < 2T/12 | 0→−60° | 2-3* | 1,2 |
| 2T/12≦t<4T/12 | −60°→−120° | *3-1 | 1,2 |
| 4T/12 | −120° | 2 | 2 |
| 4T/12<t<6T/12 | −120°→−180° | 3-1* | 2,3 |
| 6T/12≦t<8T/12 | −180°→−240° | *1-2 | 2,3 |
| 8T/12 | −240° | 3 | 3 |
| 8T/12<t<10T/12 | −240°→−300° | 1-2* | 1,3 |
| 10T/12≦t<T | −300°→−360° | *2-3 | 1,3 |

The asterisk indicates which rib the imbalance is nearest and T is the period for one revolution of the drum. Thus, if time t is 0, then rib 1 will be injected. If time t is 3T/12, then ribs 1 and 2 will be injected.

The processing means of the preferred embodiment of this invention is an Intel 8751H microcomputer. This microcomputer has sufficient read only memory (ROM) to store the program to control the balancing as well as the information from the table above. However, any processing means and storage or memory elements could easily be implemented by one skilled in the art.

Figure 8:
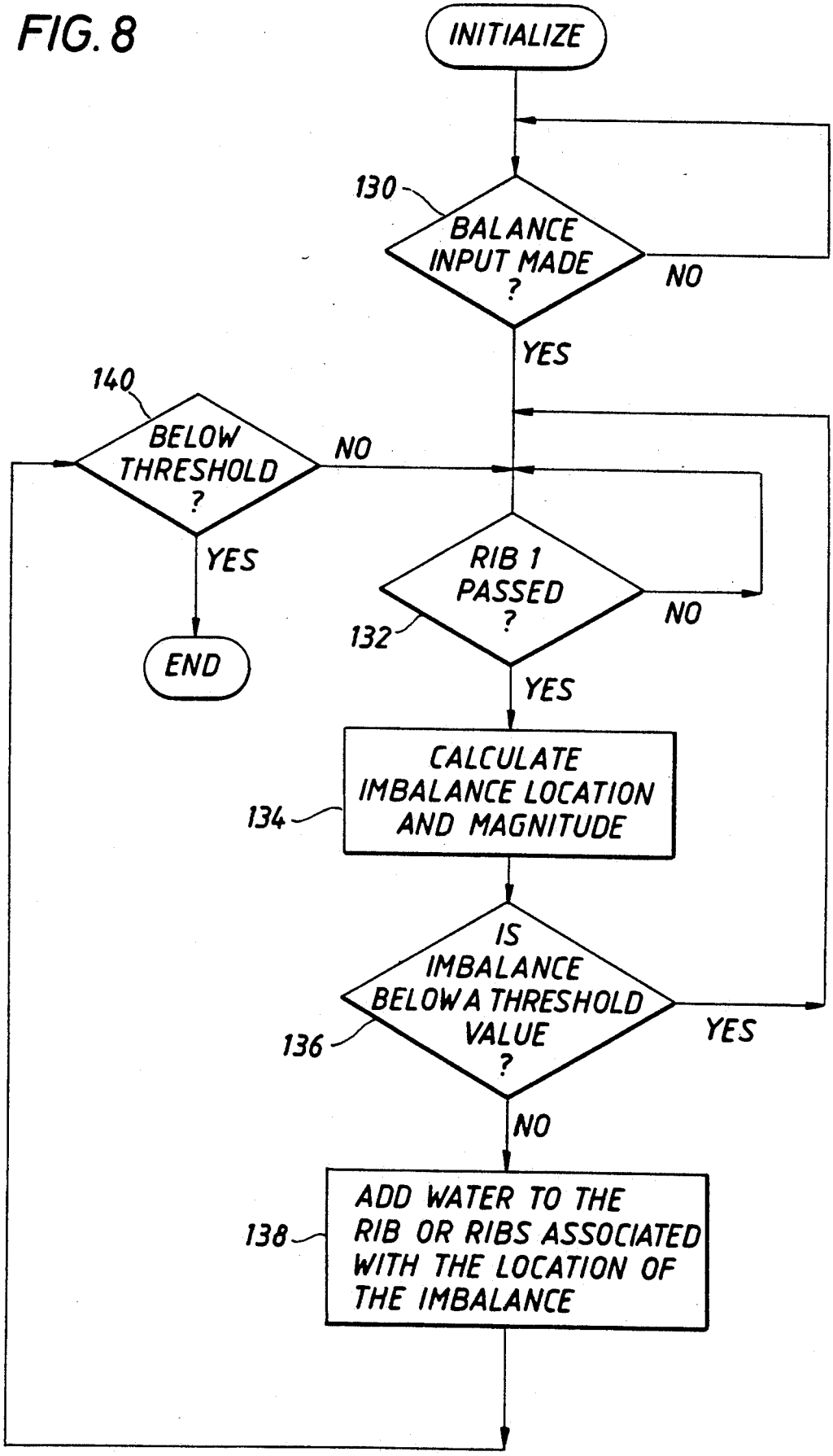
FIG. 8 is a flow diagram of the software utilized in the system of FIG. 5 to balance the machine in accordance with the preferred embodiment of this invention.

FIG. 8 shows a flow chart of the software used in the preferred embodiment to control processing means 102. First, processing means 102 waits for a balance input signal before initiating the balancing process, step 130. Processing means 102 monitors the output from proximity switch 108 to detect when rib passes the stationary reference point, step 132, and then calculates the imbalance location and magnitude by first sampling waveform 104 until a peak is detected, finding the magnitude of that peak, and then finding the location of the imbalance relative to rib 1 by calculating time t, step 134. The sampling rate is dictated by the processing unit speed, but must be faster than the rotative speed of the drum. Processing means 102 will continue to execute steps 132 and 134 until the magnitude of the imbalance reaches a threshold level, step 136, at which time processing means will inject water into the rib or ribs identified in memory associated with the calculated time t. While maintaining the injection means in the open position, steps 132, 134, 136, and 138 are reexecuted until the magnitude of the imbalance falls below a threshold level, step 140.

In an alternate embodiment of this invention, a two stage rib injection process is implemented. During Stage 1, if time t indicates the imbalance is located directly across from a rib, that rib is injected with water until the magnitude of the imbalance falls below an acceptable threshold level. Stage 2 is entered when time t indicates that the location of the imbalance is not directly across from a rib and water is injected into a predetermined rib to effectively move the location of the imbalance directly across from a rib, at which time that rib is injected to counterbalance the imbalance. For example, if the imbalance is detected when rib 1 has moved −150° from the stationary reference point, FIG. 7 shows the imbalance to be between ribs 1 and 3, but closer to 1. In order to effectively locate the imbalanced load directly across from rib 2, rib 3 is injected with water. When the effective imbalance location is across from rib 2, rib 2 is then injected until the magnitude of the imbalance falls below a given threshold.

The following table shows the relation between time t and the injected ribs utilized in the alternate embodiment of this invention, wherein, as above described, metal target 111 is angularly aligned with rib 1.

| Stage 1 | | | |
|---|---|---|---|
| Time t | Angular Location of Rib 1 from Stationary Reference Point | Imbalance Located Directly Across from a Rib | Rib to get Balancing Fluid |
| 0 | 0. 360° | 1 | 1 |
| 4T/12 | −120° | 2 | 2 |
| 8T/12 | −240° | 3 | 3 |

| Stage 2 | | | |
|---|---|---|---|
| Time t | Angular Location of Rib 1 from Stationary Reference Point | Imbalance Located Between Ribs | Rib to get Balancing Fluid |
| 0 < t < 2T/12 | 0→−60° | 2-3* | 2 |
| 2T/12≦t<4T/12 | −60°→−120° | *3-1 | 1 |
| 4T/12<t<6T/12 | −120°→−180° | 3-1* | 3 |
| 6T/12≦t<8T/12 | −180°→−240° | *1-2 | 2 |
| 8T/12<t<10T/12 | −240°→−300° | 1-2* | 1 |
| 10T/12 ≦ t <T | −300°→−360° | *2-3 | 3 |

The asterisk indicates which rib the imbalance is nearest and T is the period for one revolution of the drum. Thus, if time t is 0, then rib 1 will be injected. If time t is 3T/12, then rib 1 will also be injected.

Figure 9:
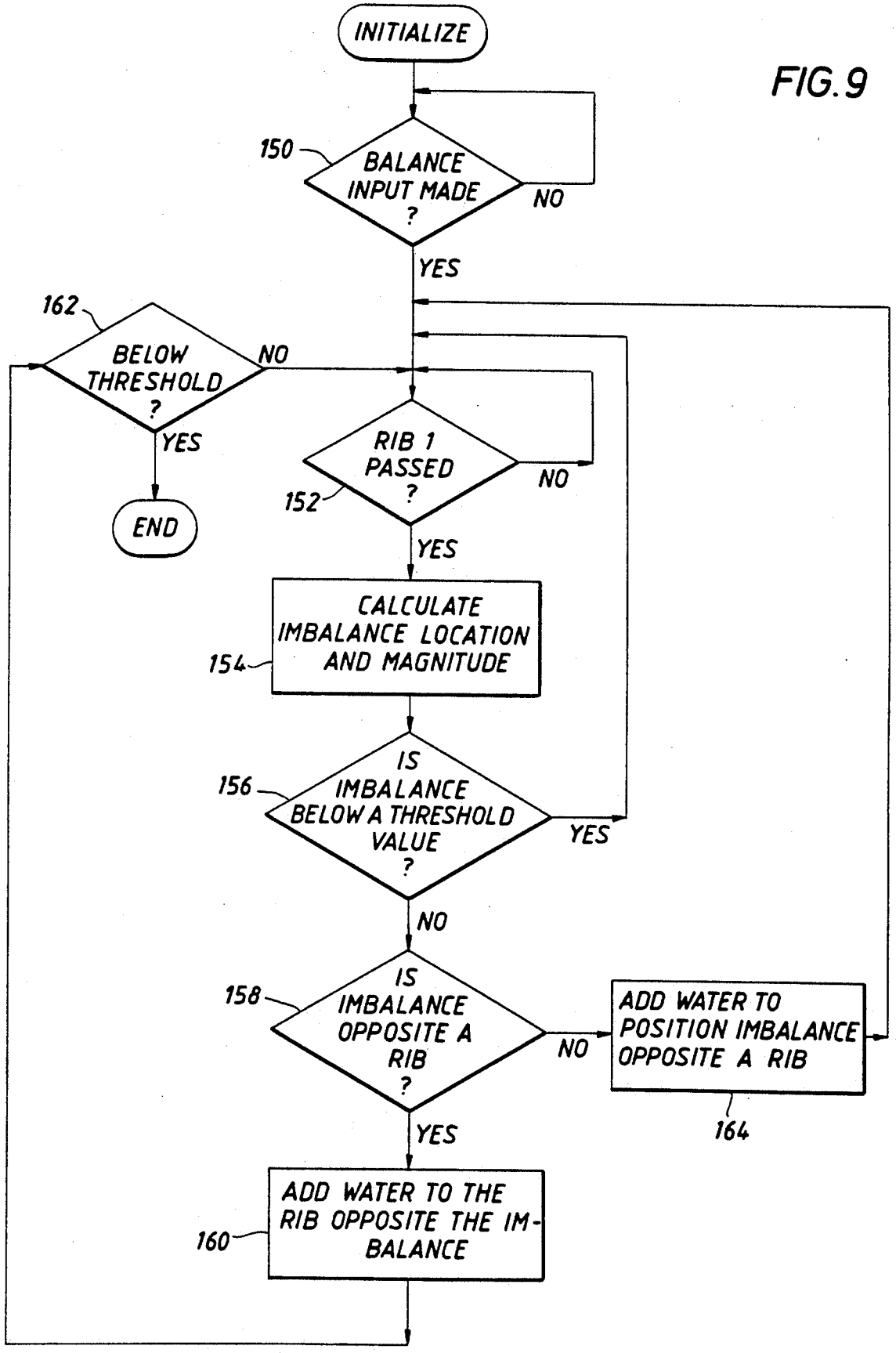
FIG. 9 is a flow diagram of the software utilized in the system of FIG. 5 to balance the machine in accordance with an alternate embodiment of this invention.

FIG. 9 shows a flow chart of the software used to control processing means 102. First, processing means 102 waits for a balance input signal to initiate the balance process, step 150. Processing means 102 monitors the output from proximity switch 108 to detect when rib 1 passes the stationary reference point, step 152, and then calculates the imbalance location and magnitude by first sampling waveform 104 until a peak is detected, finding the magnitude of that peak, and then finding the location of the imbalance relative to rib 1 by calculating time t, step 154. If the magnitude of the imbalance is below a threshold value, steps 152 and 154 will be repeated until the threshold value is reached, step 156. Once the threshold is reached, step 158 is executed to determine whether or not the imbalance is directly across from a rib by comparing the calculated time t to the values stored in memory. For example, if time t is 0, 4T/12, or 8T/12, the imbalance is directly across from a rib. If the imbalance is directly across from a rib, then the appropriate injection means is actuated and water is added to such rib, step 160. While maintaining the injection means in the open position, steps 152, 154, 156, 158, and 160 are reexecuted until the magnitude of the imbalance falls below a threshold level, step 162.

If on the other hand the location of the imbalance is not directly across from a rib, then water is injected to the rib associated with the calculated time t, through the appropriate injection means, step 164. Steps 152, 154, 156, 158, and 164 are repeated until the imbalance is effectively located across from a rib, that is, when time t is within 5 milliseconds of 0, 4T/12, or 8T/12, at which time the steps 152, 154, 156, 158, 160, and 162 are repeated until the magnitude of the imbalance fall below the threshold level. Processing unit 102 will automatically switch back to repeat steps 152, 154, 156, 158, and 164 if time t is more than 20 milliseconds away from 0,4T/12, or 8T/12.

Figure 10:
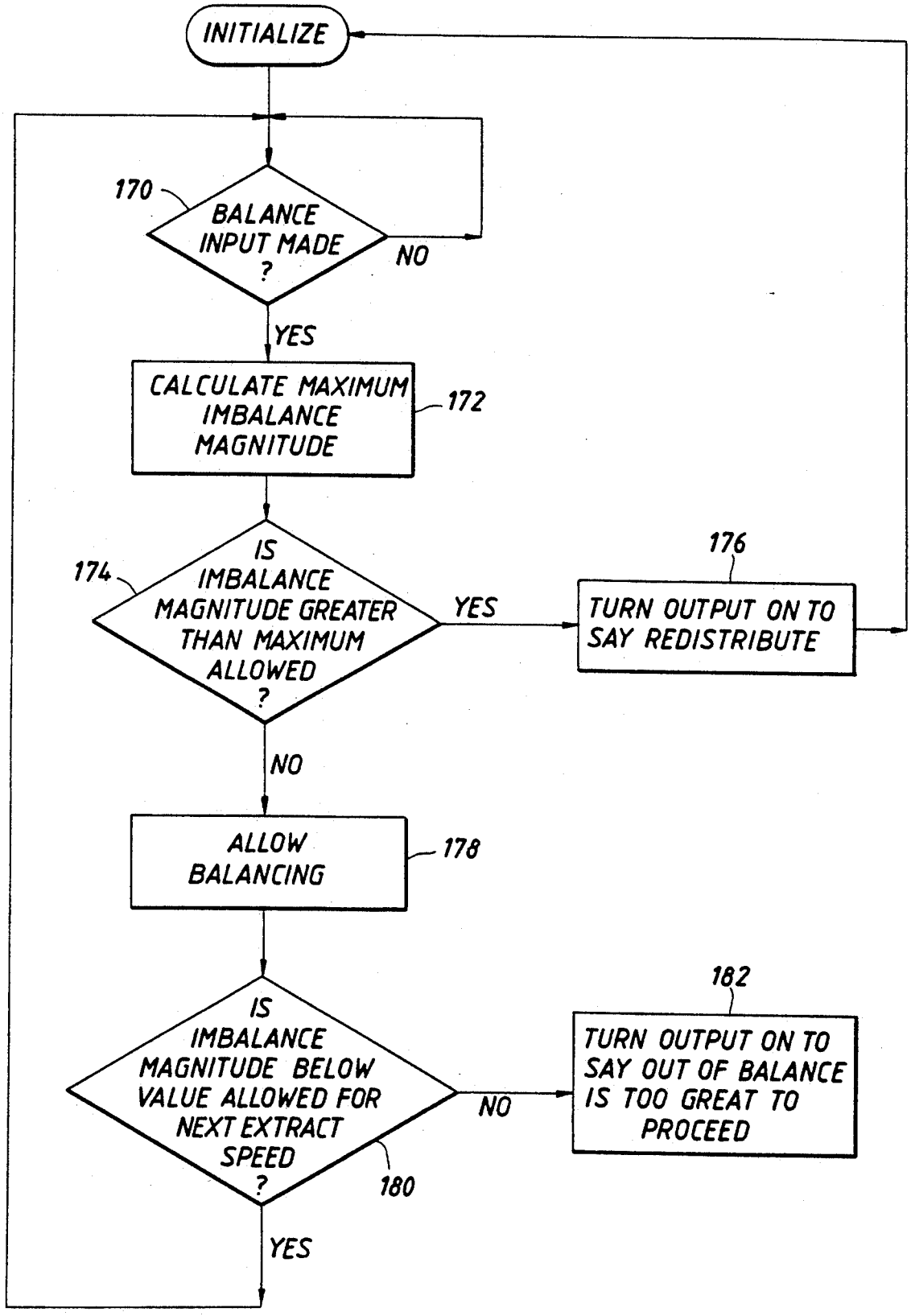
FIG. 10 is a flow diagram of the software used to prevent damage to the machine when the magnitude of the imbalance exceeds a maximum allowable level.

Since the balancing system is implemented in software, additional features can easily be added to the balancing system. For example, FIG. 10 shows the flow chart associated with the software used to prevent damage to the machine when the magnitude of the imbalance exceeds a maximum allowable level. Processing means 102 waits for balance input signal, step 170. Then the magnitude of the imbalance is calculated, step 172 and compared to a maximum allowable magnitude, step 174. If the maximum is reached then the user is told to redistribute the load in order to prevent danger, step 176. If the magnitude is below the maximum allowable level, the normal balancing occurs, step 178. If the extraction speed is changed, this software verifies that the magnitude of the imbalance is still less than the permissible value for that speed, step 180. If it is not below the maximum limit, then processing means 102 indicates that the out of balance is too great to proceed, step 182. This software represented by the flow chart in FIG. 10 is run simultaneously with the software represented by the flow chart in FIG. 9.

The actual software for processing means 102 could easily be developed with the use of the flowcharts described above. Variations of the software could also be developed by one skilled in the art. For instance, even though the flow charts of FIGS. 8 and 9 represent the software associated with the preferred and alternate embodiments of this invention, this balancing process could be performed in any of a number of ways. For example, two ribs could be injected simultaneously, but at different rates, rather than at the same rate as in the preferred embodiment of this invention.

It will be understood that certain features and subcombinations are of utility and may be employed without reference to other features and subcombinations. This is contemplated by and is in the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A machine for extracting fluids from liquid absorbent goods comprising:

a flexibly mounted outer housing;

an inner drum, rotatably mounted about its axis within said flexibly mounted outer housing, for receiving the liquid absorbent goods;

a plurality of hollow balancing compartments spaced about the inner drum;

means for injecting a balancing fluid into each compartment;

means mounted on said housing with respect to one axis for sensing acceleration in order to determine the magnitude of the imbalance during rotation;

means for determining the location of said imbalance; and means to select and activate at least one injection means based upon the location of said imbalance in order that said balancing fluid injected into said balancing compartment substantially offsets said imbalance.

2. A machine in accordance with claim 1 wherein said sensing means produces an electrical output directly proportional to said acceleration with respect to said axis.

3. A machine in accordance with claim 1 wherein said sensing means is an accelerometer.

4. A method for balancing a machine for extracting fluids from liquid absorbent goods wherein the machine includes an inner drum rotatably mounted about its axis within a flexibly supported outer housing for receiving the liquid absorbent goods, a plurality of hollow balancing compartments spaced about the inner drum, and means for injecting a balancing fluid into each compartment, comprising the steps of:

mounting an accelerometer on the flexibly supported outer housing for determining the magnitude of an imbalance in the inner drum during rotation;

determining the location of said imbalance; and selecting and activating at least one injector means based upon said location in order that said balancing fluid injected into said balancing compartment sufficiently offsets said imbalance.

5. A machine for extracting fluids from liquid absorbent goods comprising:

an outer housing;

an inner drum rotatably mounted about its axis within said outer housing for receiving the liquid absorbent goods;

a plurality of hollow balancing compartments spaced about the inner drum;

means for injecting a balancing fluid into each compartment;

means for determining passage of a target which is rotatable with said inner drum with respect to a reference point which is stationary relative to said inner drum;

means for detecting the magnitude and location of an imbalance in said inner drum during rotation;

means for determining a lapse of time to reach said imbalance location following passage of said target beyond said stationary reference point;

means for determining when the magnitude of said imbalance reaches a threshold level;

means operable, when the magnitude of said imbalance reaches said threshold level, to select and activate at least one injection means based upon said lapse of time in order that said balancing fluid injected into said balancing compartment substantially offsets said imbalance; and means for deactivating said injector means when the magnitude of said imbalance falls below said threshold level.

6. A machine in accordance with claim 5, wherein said outer housing is flexibly supported, and said imbalance magnitude and location detecting means includes an accelerometer mounted on said outer housing.

7. A machine in accordance with claim 5, wherein said means for determining passage of said target is a proximity switch mounted at said stationary reference point, wherein said target is mounted on a means for rotating said inner drum, which rotates at the same speed as said inner drum, such that said target reaches a location to activate said proximity switch once per revolution of said inner drum.

8. A machine in accordance with claim 5, wherein said means to select and activate at least one injector means includes a memory element having predetermined values that correlate at least one of said injector means with said lapse of time stored therein; and means for accessing said memory element to identify said injector means corresponding to said lapse of time, and for generating and maintaining an actuation signal for said injector means as long as the magnitude of said imbalance surpasses said threshold value.

9. A machine in accordance with claim 5, wherein said outer housing is flexibly supported;

said imbalance magnitude and location detecting means includes an accelerometer mounted on said outer housing; and said means for determining passage of said target is a proximity switch mounted at said stationary reference point, wherein said target is mounted on a means for rotating said inner drum, which rotates at the same speed as said inner drum, such that said target reaches a location to activate said proximity switch once per revolution of said inner drum.

10. A machine in accordance with claim 5, wherein said outer housing is flexibly supported;

said imbalance magnitude and location detecting means includes an accelerometer mounted on said outer housing;

said means for determining passage of said target is a proximity switch mounted at said stationary reference point, wherein said target is mounted on a means for rotating said inner drum, which rotates at the same speed as said inner drum, such that said target reaches a location to activate said proximity switch once per revolution of said inner drum; and said means to select and activate at least one injector means includes a memory element having predetermined values that correlate at least one of said injector means with said lapse of time stored therein; and means for accessing said memory element to identify said injector means corresponding to said lapse of time, and for generating and maintaining an injector means actuation signal for said injector means as long as the magnitude of said imbalance surpasses said threshold value.

11. A machine in accordance with claim 5, wherein said outer housing is flexibly supported;

said imbalance magnitude and location detecting means includes an accelerometer mounted on said outer housing; and said means to select and activate at least one injector means includes a memory element having predetermined values that correlate at least one of said injector means with said lapse of time stored therein; and means for accessing said memory element to identify said injector means corresponding to said lapse of time, and for generating and maintaining an actuation signal for said injector means as long as the magnitude of said imbalance surpasses said threshold value.

12. A machine in accordance with claim 5, wherein said means for determining passage of said target is a proximity switch mounted at said stationary reference point, wherein said target is mounted on a means for rotating said inner drum, which rotates at the same speed as said inner drum, such that said target reaches a location to activate said proximity switch once per revolution of said inner drum; and said means to select and activate at least one injector means includes a memory element having predetermined values that correlate at least one of said injector means with said lapse of time stored therein; and means for accessing said memory element to identify said injector means corresponding to said lapse of time, and for generating and maintaining an actuation signal for said injector means as long as the magnitude of said imbalance surpasses said threshold value.

13. A machine in accordance with claim 5, further comprising:

means for determining when said imbalance exceeds a maximum allowable limit; and means for reducing the inner drum rotation speed.

14. A method for balancing a machine for extracting fluids from liquid absorbent goods wherein the machine includes a inner drum rotatably mounted about its axis within a outer housing for receiving the liquid absorbent goods, a plurality of hollow balancing compartments spaced about the inner drum, and means for injecting a balancing fluid into each compartment, comprising the steps of:

detecting passage of a target which is rotatable with said inner drum with respect to a reference point which is stationary relative to said inner drum;

detecting the magnitude and location of an imbalance in the inner drum during rotation;

determining a lapse of time to reach said imbalance location from said passage of said target point beyond said stationary reference point;

determining when the magnitude of said imbalance reaches a threshold level;

selecting and activating at least one injector means based upon said lapse of time when the magnitude of said imbalance reaches a threshold level, in order that said balancing fluid injected into said balancing compartment sufficiently offsets said imbalance; and deactivating said injector means when the magnitude of said imbalance falls below said threshold level.

* * * * *